US006857252B2

(12) United States Patent
Haberstroh et al.

(10) Patent No.: US 6,857,252 B2
(45) Date of Patent: Feb. 22, 2005

(54) STRAPPING MACHINE WITH STRAP PATH ACCESS GUIDE

(75) Inventors: James A. Haberstroh, Vernon Hills, IL (US); Timothy B. Pearson, Antioch, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/601,285

(22) Filed: Jun. 20, 2003

(65) Prior Publication Data

US 2004/0255562 A1 Dec. 23, 2004

(51) Int. Cl.[7] ..... B65B 13/06; B65B 13/32

(52) U.S. Cl. ..... 53/589; 53/375.9; 100/26; 100/29; 100/32; 100/33 PB

(58) Field of Search ..... 53/589, 375.9; 100/26, 29, 32, 33 PB

(56) References Cited

U.S. PATENT DOCUMENTS

| | | | | |
|---|---|---|---|---|
| RE27,427 E | * | 7/1972 | Leslie et al. | 100/26 |
| 4,502,911 A | * | 3/1985 | Discavage | 100/33 PB |
| 4,952,270 A | * | 8/1990 | Sakaki et al. | 100/33 PB |
| 5,746,882 A | | 5/1998 | Bell et al. | |
| 6,478,065 B1 | | 11/2002 | Haberstroh et al. | |
| 6,715,408 B1 | * | 4/2004 | Rossi | 53/589 |

FOREIGN PATENT DOCUMENTS

| | | |
|---|---|---|
| EP | 1 002 720 | 5/2000 |

OTHER PUBLICATIONS

European Search Report Ref. No. 04.19294EP S/g 23/09/2004.

* cited by examiner

*Primary Examiner*—Stephen F. Gerrity
(74) *Attorney, Agent, or Firm*—Mark W. Croll, Esq.; Donald J. Breh, Esq.; Welsh & Katz, Ltd.

(57) ABSTRACT

A strap path access guide is configured for use in a strapping machine of the type having a feed assembly a chute and a strapping head disposed between the feed assembly and the chute. The strapping machine is configured to receive first and second courses of associated strap material, position, tension and seal the strap material around a load. The strap path access guide is disposed along the feed assembly between a pair of tensioning wheels and the strapping head. The strap path access guide includes a fixed lower guide portion extending between the tensioning wheels and the strapping head. The fixed lower guide portion defines a lower surface of the strap path. A pivotable upper guide portion is pivotable about a pivot that is spaced from and rearwardly beyond the tensioning wheels. The upper guide portion is pivotable between a closed position in which the upper and lower guide portions cooperate with one another to define the strap path and an open position in which the strap path is fully accessible. The upper guide portion is pivotable in a plane transverse to a direction of travel of strap material through the strap path. A latching element secures the upper guide portion in the closed position.

21 Claims, 3 Drawing Sheets

STRAPPING MACHINE WITH STRAP PATH ACCESS GUIDE

BACKGROUND OF THE INVENTION

The present invention is directed to an improvement in a strapping machine. More particularly, the present invention is directed to a strapping machine having a readily accessible strap path.

Strapping machines are in widespread use for securing straps around loads. One type of known strapper is a stationary unit that includes a strapping head or weld head and drive mechanism mounted within a frame. A chute is mounted to the frame, through which the strapping material is fed. In a typical arrangement, a table-top or work surface is likewise mounted to the frame.

In a typical stationary strapper, the chute is mounted from about the work surface, and the strapping head is mounted below the work surface. Strap is fed from a source or dispenser to the strapping or welding head. The strapping head provides a number of functions. First, it includes a plurality of grippers for gripping portions of the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating overlying courses of the strap by use of a heating element.

Strapping material is fed from the dispenser into the strapping head first via a pair of infeed wheels and second via a feed assembly. The infeed wheels are typically located immediately inside of the strapping machine (e.g., inside of an enclosure or cabinet). The infeed wheels facilitate smoothly feeding the strapping material into the strapper and further supply strapping material into the slack box. The slack box is an area between the infeed wheels and the strapping head that is used to store a length of "slack" strapping material for use by the strapping head and is also an area for storing take-up strap that has been rewound or tensioned around the load.

The feed assembly includes a pair of tensioning wheels and a pair of feed wheels. The tensioning wheels are locate downstream of the infeed wheels, and a guide extends between the tensioning and in feed wheels. The slack box is disposed about the guide area, between the infeed and tensioning wheels.

Between the tensioning wheels and the strapping head, a typical strapper includes a pair of feed wheels for feeding the strap material into the strapping head (and around the strap chute). A guide is disposed between the tensioning wheels and the feed wheels to provide a pathway for the strap as it is fed into the strapping head by the feed wheels and as it is pulled from the strapping head (and from around the chute) by the tensioning wheels.

It has been found that when strap misfeeds occur, it is often desirable or perhaps necessary to access the area between the feed wheels and the tensioning wheels. To this end, strappers have been configured with openable access panels that permit reaching in to the strap path to, for example, manually clear any strap from between the tensioning and feed wheels. The access panels, however, are configured to open across the strap in the direction of travel. As such, the area available for accessing the strap is limited, and there exists the possibility for strap damage as a result of the opening and closing of the access panels.

Accordingly, there is a need for a strapping machine having a readily accessible strap path. Desirably, such a strapping machine provides ready access to the entire length of the strap path (or to the guide). Most desirably, such access provides sufficient area or space within which to carry out necessary tasks at about the path, the feed wheels and the tensioning wheels.

BRIEF SUMMARY OF THE INVENTION

A strap path access guide is configured for use in a strapping machine of the type having a feed assembly and a chute and a strapping head disposed between the feed assembly and the chute. The strapping machine is configured to receive first and second courses of associated strap material, position, tension and seal the strap material around a load.

In such a machine, the feed assembly includes a pair of tensioning wheels and a pair of feed wheels disposed along a strap path. The feed wheels feed the strap material into and around the chute and the tensioning wheels retract the strap material and tension the strap material around the load.

The strap path access guide includes a fixed lower guide portion extending between the tensioning wheels and the strapping head. The fixed lower guide portion defines a lower surface of the strap path.

A pivotable upper guide portion pivots about a pivot that is spaced from and rearwardly beyond the tensioning wheels. The upper guide portion is pivotable between a closed position in which the upper and lower guide portions cooperate with one another to define the strap path and an open position in which the strap path is fully accessible. The upper guide portion is pivotable in a plane that is transverse to a direction of travel of strap material through the strap path. A latching element secures the upper guide portion in the closed position.

Preferably, a latch secures the upper guide portion in the closed position. A biasing element biases the latch to a latched position.

The upper guide portion can be configured for carrying one of the feed wheels, such as an idler or pinch wheel. Preferably, the idler or pinch wheel is mounted to a biased assembly for biasing that wheel toward the lower guide portion. The lower guide portion can include an opening in the lower portion of the strap path for receiving a driven feed wheel.

A feed assembly having the strap path access guide and a strapping machine having the strap path access guide are also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
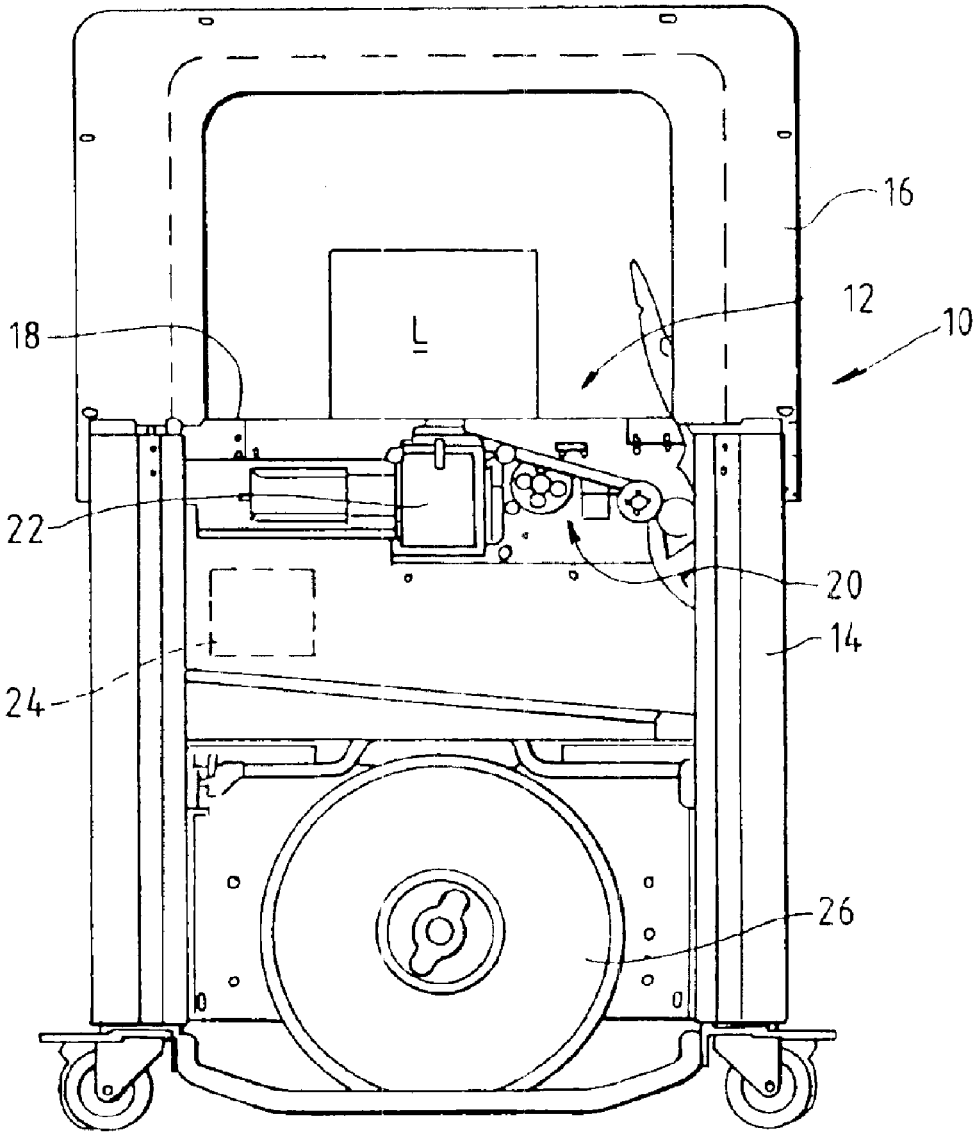
FIG. 1 is a front view of an exemplary strapping machine having a strap path access guide embodying the principles of the present invention.
Figure 2:
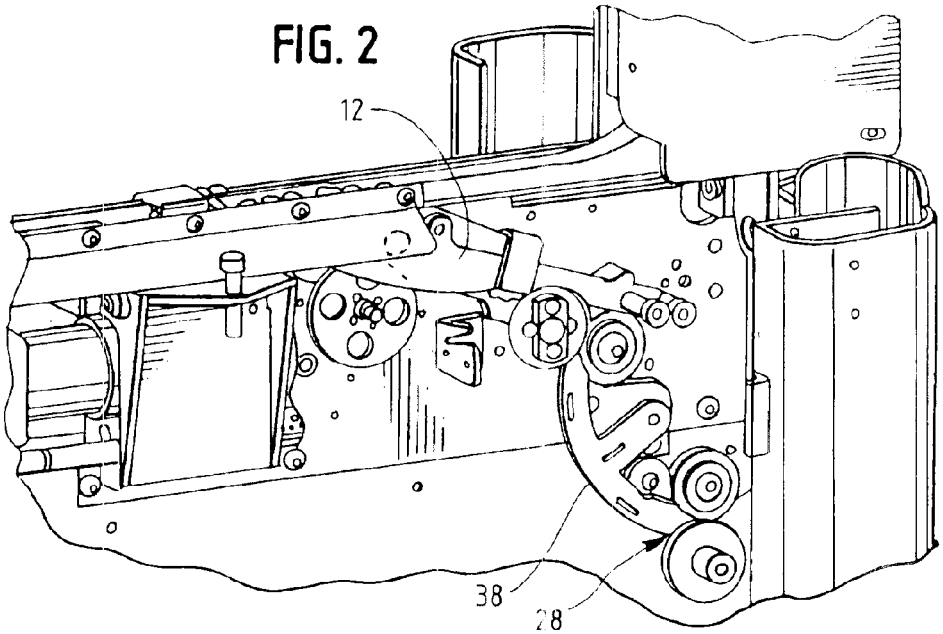
FIG. 2 is a perspective illustration of a portion of the strapping machine showing the strap path access guide in the closed position.
Figure 3:
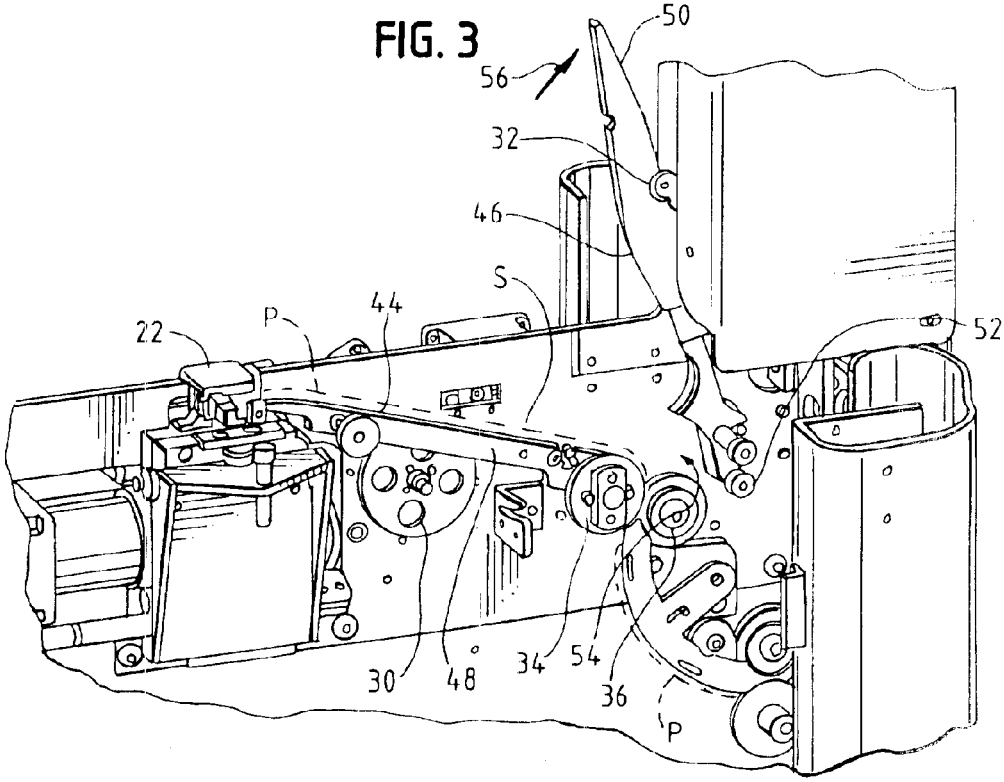
FIG. 3 is a perspective illustration similar to FIG. 2 showing the guide in the open position.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having a strap path access guide 12 embodying the principles of the present invention. The strapping machine 10 includes, generally, a frame 14, a strap chute 16 and a table top or work surface 18. A feed assembly 20 and a strapping head 22 are mounted below the work surface 18. A controller 24 provides automatic operation and control of the strapper 10.

The strapping head 22 receives strapping material S from a dispenser 26. The strap S is fed or pulled from the dispenser 26 by infeed wheels 28. In a typical arrangement, the infeed wheels 28 are mounted immediately inside of and within the machine 10. The feed assembly 20, includes two pairs of wheels, namely a pair of feed wheels 30, 32 and a pair of tensioning wheels 34, 36.

Referring to FIGS. 2–5, the feed wheels 30, 32 feed strapping material S into the strapping head 22 and chute 16 (for conveyance around the chute 16). The tensioning wheels 34, 36 take-up or tension the strapping material S around the load L. The feed wheels include a driven wheel 30 and an idler or pinch wheel 32 and the tensioning wheels include a driven wheel 34 and an idler or pinch wheel 36.

A lower guide 38 is positioned between the infeed wheels 28 and the tensioning wheels 34 36. A slack box 40 is disposed at about the lower guide 38, also positioned between the infeed wheels 28 and the tensioning wheels 34, 36. The slack box 40 is used as a "storage" region for the strap S that has been fed into the machine 10 but has not yet been pulled into the strapping head 22, and for strap S that has been taken-up from around the load L, as during the tensioning cycle.

The strap path access guide 12 or upper strap guide (or upper guide) is positioned between the tensioning wheels 34, 36 and the strapping head 22. The feed wheels 30, 32 lie, in part, along the upper guide 12 and urge or push the strap S into the strapping head 22. The upper guide 12 provides a smooth, unobstructed path for moving the strap material S into the chute 16.

The upper guide 12 is one of the areas at which access to the strap path P is desired for maintenance, inspection and the like. To this end, it is desirable to have ready and complete access to the surfaces 44, 46 along which the strap S travels as it moves through the guide 12. However, in that the upper guide 12 provides both upper and lower surfaces 44, 46 (to essentially envelope the upper and lower surfaces of the strap S or to define a track) it is necessary that at least one portion of the guide 12 is configured as a removable element.

Figure 4:
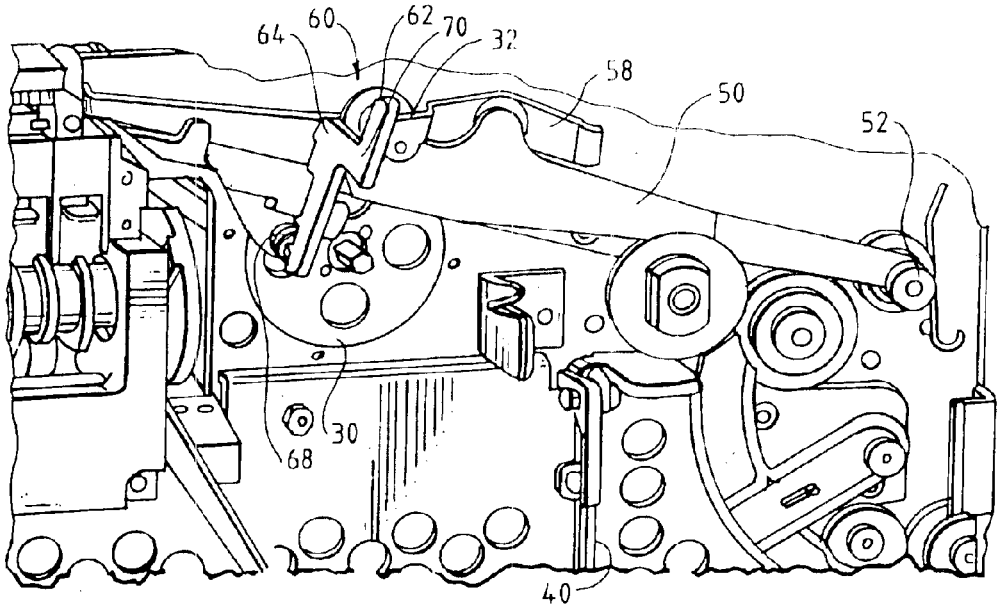
FIG. 4 is a perspective illustration similar to FIG. 2 showing the guide closed.
Figure 5:
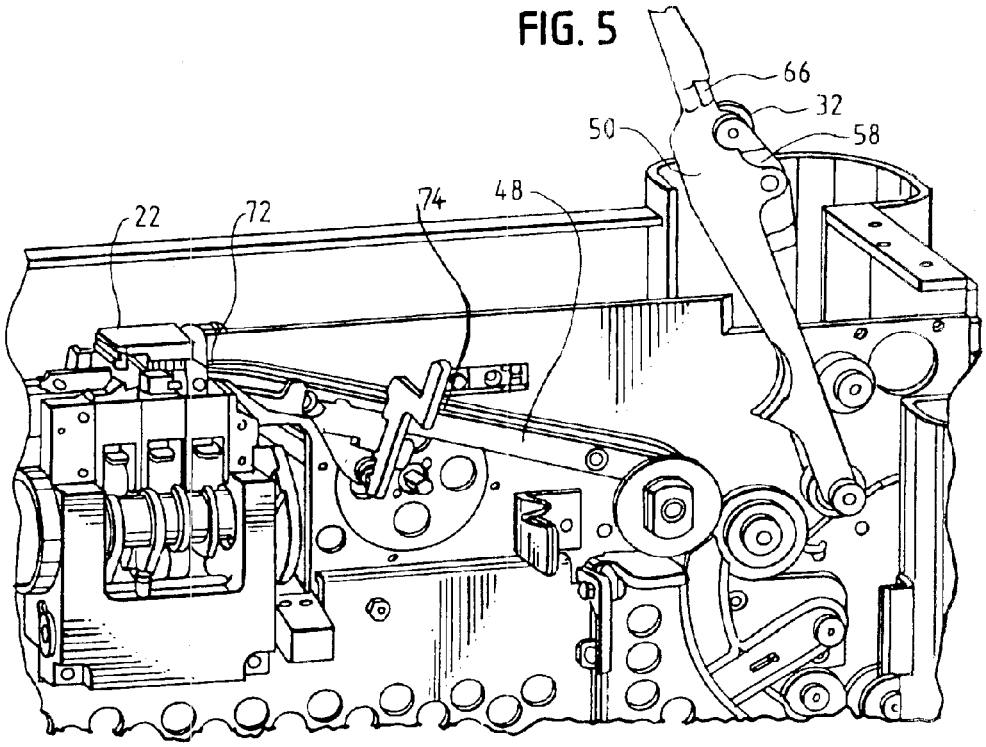
FIG. 5 is a perspective illustration similar to FIG. 3 showing the guide open.

As seen in FIGS. 4 and 5, the upper guide 12 includes a fixed lower portion 48 and a movable upper portion 50. The upper portion 50 is pivotable about a pivot axis or pin 52 (that defines an axis of rotation) that is outside of the strap path P. That is, the pivot axis 52 is beyond the rearward entrance to the guide (indicated generally at 54) at the tensioning wheels 34, 36. In that the strap path P turns at the tensioning wheels 34, 36, the upper portion 50 fully overlies the strap path P and pivots at a location 52 that is displaced from the path P. In this manner, rather than possibly pinching down on the strap S at a point in the strap path P at which the strap S turns, the location 52 at which the upper guide portion 50 pivots is away from the strap path P.

Moreover, as will be appreciated from the figures, the upper guide portion 50 pivots in a direction (indicated by the arrow at 56) that is transverse to the strap path P. This also enhances access to the path P in that the entire width of the path P (and additional space on the sides of the path P, laterally as well as longitudinally) are accessible.

The driven feed wheel 30 is fixed relative to the fixed lower guide portion 48. The idler feed wheel 32 is mounted to the upper guide portion 50 for pivoting with the upper portion 50. In this manner, the entirety of the strap path P is clear when the upper portion 50 is pivoted upwardly to access the path P. In a present strapping machine, the idler wheel 32 is mounted to the upper guide portion 50 by a biased mounting assembly 58. In this manner, the idler wheel 30 maintains contact with the strap S so long as the upper guide portion 50 is in place on the lower guide portion 48 (closing the upper guide 12), as in the operating position.

The upper guide portion 50 is maintained secured in place by a latching assembly 60. The latching assembly 60 includes a pivoting latch portion 62 that is mounted to the fixed lower guide portion 48 that closes onto the upper guide portion 50. A finger 64 extends from the latch 62 to overlie a lip 66 on the upper guide portion 50 to retain the upper portion 50 in place. The latch portion 62 is biased to the closed position (by a spring 68) to maintain the guide 12 closed. To open the guide 12 (i.e., to pivot the upper portion 50), the latch 62 includes a flange 70 that is depressed that pivots the latch 62 to release the finger 64 from the lip 66.

The feed wheels 30, 32 are located at an intermediate point along the guide 12. In this configuration, a distal end 72 of the guide 12 opens directly in to the strapping head 22 to provide a smooth transition from the guide 12 into the strapping head 22. The lower guide portion 48 has an opening 74 therein, through which the driven wheel 30 extends, to lie in or along the strap path P.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strap path access guide for a strapping machine of the type having a feed assembly and a chute, the strapping machine including a strapping head disposed between the feed assembly and the chute, the strapping machine configured to receive first and second courses of associated strap material, position, tension and seal the strap material around a load, the feed assembly including a pair of tensioning wheels and a pair of feed wheels disposed along a strap path, the feed wheels feeding the strap material into and around the chute and the tensioning wheels retracting the strap material and tensioning the strap material around the load, the strap path access guide comprising:

a fixed lower guide portion extending between the tensioning wheels and the strapping head, the fixed lower guide portion defining a lower surface of the strap path;

a pivotable upper guide portion, the upper guide portion pivotable about a pivot point that is spaced from and rearwardly beyond the tensioning wheels, the upper guide portion pivotable between a closed position in which the upper and lower guide portions cooperate with one another to define the strap path and an open position in which the strap path is fully accessible, the upper guide portion being pivotable in a plane transverse to a direction of travel of strap material through the strap path; and a latching assembly for securing the upper guide portion in the closed position.

2. The strap path access guide in accordance with claim 1 wherein the latching assembly includes a latch for securing the upper guide portion in the closed position.

3. The strap path access guide in accordance with claim 2 including a biasing element for biasing the latch to a latched position.

4. The strap path access guide in accordance with claim 1 wherein the upper guide portion is configured for carrying one of the feed wheels.

5. The strap path access guide in accordance with claim 4 wherein the one of the feed wheels is an idler wheel.

6. The strap path access guide in accordance with claim 5 wherein the idler wheel is mounted to a biased assembly for biasing the idler wheel toward the lower guide position.

7. The strap path access guide in accordance with claim 1 wherein the lower guide portion includes an opening in the lower portion of the strap path, the opening configured for receiving one of the feed wheels.

8. A feed assembly for a strapping machine of the type having a chute, and a strapping head disposed between the feed assembly and the chute, the strapping machine configured to receive first and second courses of associated strap material, position, tension and seal the strap material around a load, the feed assembly comprising:

a pair of tensioning wheels and a pair of feed wheels disposed along a strap path, the feed wheels feeding the strap material into and around the chute and the tensioning wheels retracting the strap material and tensioning the strap material around the load, a strap path access guide defining a portion of a strap path, the strap path access guide having a fixed lower guide portion extending between the tensioning wheels and the strapping head, the fixed lower guide portion defining a lower surface of the strap path, the strap path access guide including a pivotable upper guide portion pivotable about a pivot that is spaced from and rearwardly beyond the tensioning wheels, the upper guide portion pivotable between a closed position in which the upper and lower guide portions cooperate with one another to define the strap path and an open position in which the strap path is fully accessible, the upper guide portion being pivotable in a plane transverse to a direction of travel of strap material through the strap path and a latching assembly for securing the upper guide portion in the closed position.

9. The strap path access guide in accordance with claim 8 wherein the latching assembly includes a latch for securing the upper guide portion in the closed position.

10. The feed assembly in accordance with claim 9 including a biasing element for biasing the latch to a latched position.

11. The feed assembly in accordance with claim 8 wherein the upper guide portion is configured for carrying one of the feed wheels.

12. The feed assembly in accordance with claim 11 wherein the one of the feed wheels is an idler wheel.

13. The feed assembly in accordance with claim 12 wherein the idler wheel is mounted to a biased assembly for biasing the idler wheel toward the lower guide portion.

14. The feed assembly in accordance with claim 8 wherein the lower guide portion includes an opening in the lower portion of the strap path, the opening configured for receiving one of the feed wheels.

15. A strapping machine of the type configured to receive first and second courses of associated strap material, position, tension and seal the strap material around a load, comprising:

a feed assembly, a chute; and a strapping head disposed between the feed assembly and the chute;

an infeed arrangement; and a strap supply for supplying strap material to the feed assembly through the infeed arrangement, the feed assembly including a pair of tensioning wheels and a pair of feed wheels disposed along a strap path, the feed wheels feeding the strap material into and around the chute and the tensioning wheels retracting the strap material and tensioning the strap material around the load, the feed assembly including a strap path access guide having a fixed lower guide portion extending between the tensioning wheels and the strapping head, the fixed lower guide portion defining a lower surface of the strap path, a pivotable upper guide portion, the upper guide portion pivotable about a pivot that is spaced from and rearwardly beyond the tensioning wheels, the upper guide portion pivotable between a closed position in which the upper and lower guide portions cooperate with one another to define the strap path and an open position in which the strap path is fully accessible, the upper guide portion being pivotable in a plane transverse to a direction of travel of strap material through the strap path and a latching assembly for securing the upper guide portion in the closed position.

16. The strap path access guide in accordance with claim 15 wherein the latching assembly includes a latch for securing the upper guide portion in the closed position.

17. The strapping machine in accordance with claim 16 including a biasing element for biasing the latch to a latched position.

18. The strapping machine in accordance with claim 15 wherein the upper guide portion is configured for carrying one of the feed wheels.

19. The strapping machine in accordance with claim 18 wherein the one of the feed wheels is an idler wheel.

20. The strapping machine in accordance with claim 19 wherein the idler wheel is mounted to a biased assembly for biasing the idler wheel toward the lower guide portion.

21. The strapping machine in accordance with claim 15 wherein the lower guide portion includes an opening in the lower portion of the strap path, the opening configured for receiving one of the feed wheels.

* * * * *